US006386298B1

(12) United States Patent
Smith et al.

(10) Patent No.: US 6,386,298 B1
(45) Date of Patent: May 14, 2002

(54) APPARATUS FOR DIRECTIONAL DRILLING

(76) Inventors: Michael Gerald Smith, 3941 Kirby Dr., #815, Ft. Worth, TX (US) 76155; Melvin Flois Hicks, 218 Lorraine St., Keller, TX (US) 76248

( * ) Notice: Subject to any disclaimer, the term of this patent is extended or adjusted under 35 U.S.C. 154(b) by 9 days.

(21) Appl. No.: 09/583,636

(22) Filed: May 30, 2000

(51) Int. Cl.[7] ..... E21B 9/22
(52) U.S. Cl. ..... 175/53; 175/385; 175/406
(58) Field of Search ..... 175/53, 385, 406, 175/61, 62; 405/184

(56) References Cited

U.S. PATENT DOCUMENTS 4,049,067 A 9/1977 Dively
4,142,598 A 3/1979 Maxsted
4,228,863 A * 10/1980 Liljekvist et al. ..... 175/344
4,386,670 A 6/1983 Westermark
5,337,843 A 8/1994 Torgrimsen et al.
5,485,888 A 1/1996 England
5,628,585 A * 5/1997 Parish, II et al. ..... 175/53
5,979,574 A 11/1999 Osadchuk

* cited by examiner

*Primary Examiner*—William Neuder
(74) *Attorney, Agent, or Firm*—Colin P. Cahoon; Carstens, Yee & Cahoon, L.L.P.

(57) ABSTRACT

A hole opener and method for using same which allows for a greater number of cone utters to be attached to the hole opener. The support structure provided by the present invention uses a barrel which is attached to the drill stem to effectively increase the diameter of the drill stem so that additional cutters may be attached to the hole opener. Using the barrel structure, the structural integrity of the tool is not compromised, and a strong support structure for the cutters is provided. The cone cutters may be removable from the barrel. The removable structure is provided by placing a bolt inside the segments which is used to mate the segment with a pocket attached to the barrel. This results in a very versatile tool in that the same boring head may be used for boring various types of materials. The barrel structure of the present invention also provides a means for trapping cones inside the barrel to prevent the cone cutters from being left inside the hole. The tapered shape of the hole opener allows it to be forced back to the point of entry after drilling in order to displace debris.

49 Claims, 5 Drawing Sheets

APPARATUS FOR DIRECTIONAL DRILLING

BACKGROUND OF THE INVENTION

1. Technical Field

The present invention relates to a hole opener boring apparatus and method for using such and more particularly to an improved mounting structure for a hole opener that allows a greater number of cutters to be placed on the hole opener.

2. Description of Related Art

Hole openers are used when pipelines, cables, or culverts, for example, must be installed under surface barriers such as highways, buildings, waterways and other surface obstructions without disturbing the surface. Before a hole opener is used, a trench is opened on both sides of the barrier. A pilot bore is formed under the barrier. If the pilot bore is of insufficient diameter to install the pipeline, then the hole may be opened up using a hole opener. Next a boring head which is also referred to in the art as a reamer or hole opener, is used to enlarge the pilot bore. Generally, a guide is positioned on the advancing side of the boring head. The guide on the boring head is designed to engage the walls of the pilot bore and help steer the pipeline boring head while the pilot bore is being enlarged. Drilling fluids are also supplied to the boring operation through the drill stem in the pilot bore to produce a slurry which floats the drilled material out the end of the hole. After a hole is opened up using the hole opener, a section of the pipeline is either pushed or pulled lengthwise through the bore from one side of the barrier to the other. The pipeline may also be pulled through by the hole opener as the hole is being opened. The installed pipeline section may then be welded into place and tested.

Various types of reamers or hole openers have been disclosed in the prior art. One such opener has cone cutters which are mounted around the circumference of an axial shaft called a drill stem that is used to drive the hole opener. These cutters have been mounted by attaching plates perpendicular to the drill stem to which the cutters are then attached. The number of cutters that may be mounted to the drill stem using current methods is limited because of the tremendous forces placed on the cone cutters when in operation. The support structure attached to the drill stem must be sufficiently strong to prevent excessive breakage during a drilling operation.

Because of the limitations posed by the current support structures used to mount the cutters to the drill stem, the number of cone cutters that may be placed around the circumference of the boring head is limited. This limitation in the number of cutters varies depending on the diameter of the cutter. However, regardless of the diameter of the cutter, the structural methods used in the prior art severely limit the number of cutters allowed. Thus, the prior art tools are very rough in operation when used in hard material such as rock or hard gravel. The prior art tools also require much more power than would be required if more cutters could be added to the circumference of the tool. The prior art hole openers are analogous to a square wheel in that they are very rough in operation, and they tend to produce holes which are elongated or egg-shaped because of the rough operation. The rough operation also increases the likelihood that the cone cutters will break and be left in the hole. The removal of cone cutters from a prior art boring head after a drilling operation has proven to be very difficult and expensive because of the primitive attachment means that have been used.

Furthermore, the tools of the prior art could not be pushed backwards through the hole easily because the tools had a tendency to sink or grab along the edges of the holes due to the flat backs of the tools. The use of only four cones on prior art devices causes excessive friction between the tool and the walls of the hole making it even more difficult to push the tools back through the hole. Thus, it is virtually impossible to push prior art tools back through the hole in order to smooth the jagged edges inside the hole and mechanically push debris out of the hole. In order to produce a clean hole using prior art tools, the tool is pulled through very slowly while drilling fluids are liberally applied at the hole opener to produce a slurry that floats the debris out of the hole. Alternatively, a different tool may be attached to the drilling rig for pushing the debris out of the hole. However, this is very time consuming because of the time required in changing the tools and is more expensive because a separate tool is required.

Therefore, it would be desirable to provide a hole opener more analogous to a round wheel to reduce vibration and to reduce the size of the power supply required to operate the tool. A reduction in the size of the power supply would allow smaller boring machines to enter markets which were previously open only to larger drilling rigs. A support structure for the hole cutters is needed which will accommodate an increased number of cone cutters around the circumference of the boring head to provide a hole opener which operates smoothly. It is also desirable for the hole cutter to be capable of collecting cone cutters as they break off to avoid leaving the broken cone cutters in the hole and thereby reduce the expense of drilling operations. Furthermore, the cone cutters should be easily removable so that new or different styles or sizes of cone cutters may be installed between drilling operations. Finally, the hole cutter should be capable of being pushed back through the hole in order to provide an effective and efficient means for mechanically pushing the material out the end of the hole without requiring the insertion of a different tool.

SUMMARY OF THE INVENTION

The present invention provides a hole opener support structure which allows for a greater number of cone cutters to be attached to the hole opener. Increasing the number of cone cutters decreases the roughness of operation of the hole opener and produces a hole which is round rather than oblong or egg-shaped. Consequently, much less power is required to operate a hole opener of the same diameter than is required by the prior art tools. The support structure provided by the present invention uses a barrel which is attached to the drill stem to effectively increase the diameter of the drill stem so that additional cutters may be attached to the hole opener. Using the barrel structure, the structural integrity of the tool is not compromised, and a strong support structure for the cutters is provided. The tapered shape of the hole opener allows the hole opener to be easily pushed back through the hole to displace debris left behind the hole opener as the hole is being cut. Because debris may be mechanically displaced from the hole using the method of the present invention, much less drilling fluid is required to open a hole.

In one embodiment of the present invention, the barrel has openings in the front and back to allow drilling fluid and material to pass through the hole opener. The openings are such that broken cone cutters are deposited through the front openings and trapped in the barrel, thereby preventing the broken cone cutters from being left in the hole. Furthermore, the cone cutters may be easily removed from the barrel between drilling operations. This feature is provided by embedding a bolt in a groove within the cone cutter segment. The bolt is used to secure the segment to a pocket attached to the barrel. Because the bolt itself is replaceable, the life of the cone cutter segments are prolonged. This results in a very versatile tool in that the same hole opener may be used for boring various types of materials, and less time is required to change worn-out cone cutters.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings wherein:

DETAILED DESCRIPTION

Figure 1:
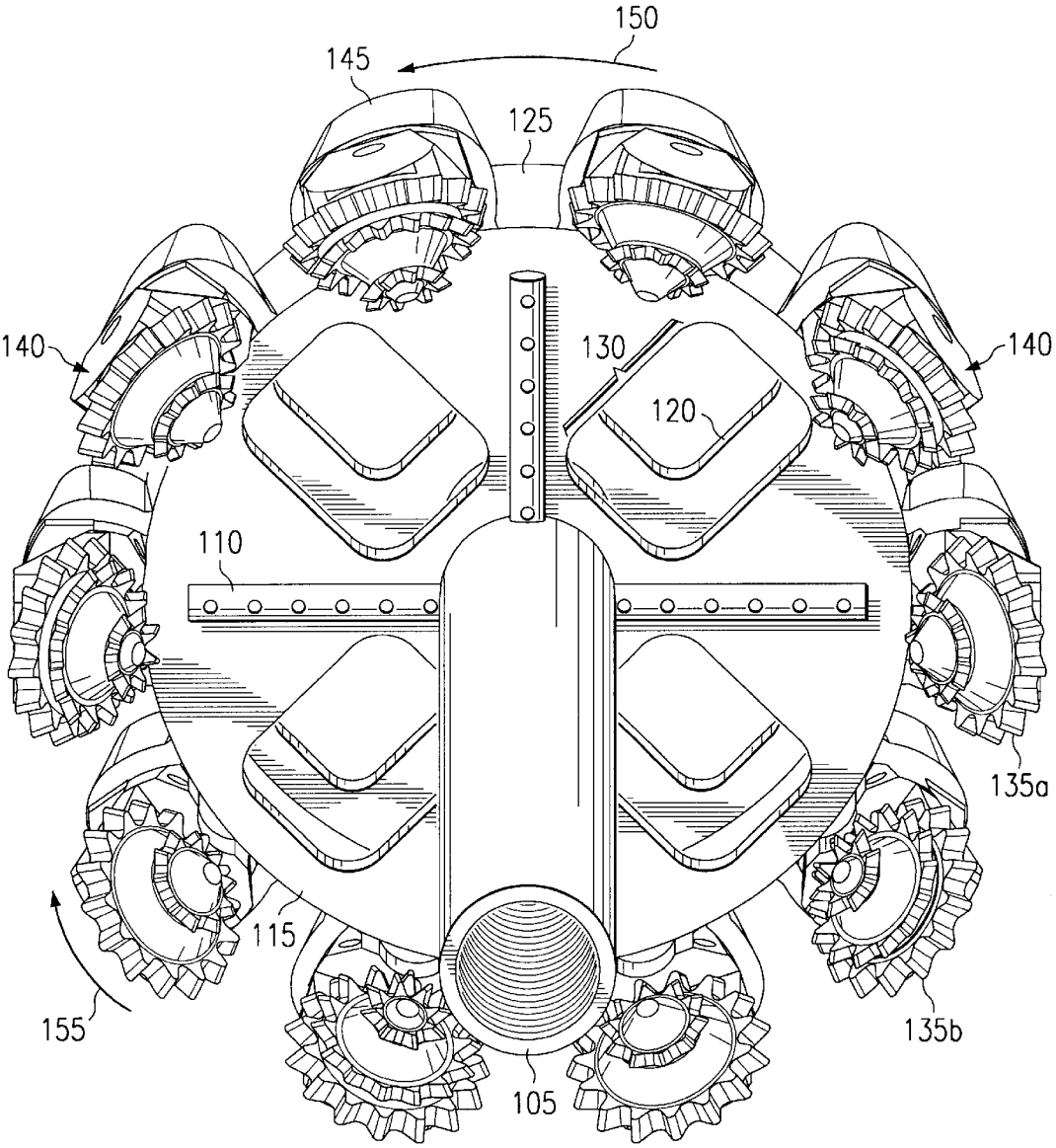
FIG. 1 is a front perspective view of an embodiment of a hole opener in accordance with the present invention.

Referring now to FIG. 1, a front perspective view of an embodiment of a hole opener in accordance with the present invention is illustrated. A drill stem 105 extends from the front of the cutter to act as a pilot and a drive shaft for the hole opener. The drill stem 105 is threaded to allow extensions of the drill stem 105 to be attached. The drill stem 105 passes through a pilot hole that is bored prior to the insertion of the hole opener. The drill stem 105 is hollow for pumping drilling fluid through the drill stem and out fluid ports to liquify the material into a mud so that it more easily passes through or around the hole opener during the drilling operation. Water tubes 110 in fluid communication with the drill stem 105 may be attached to the drill stem to act as a fluid communicator to spray water out over the loose material. The water tubes 110 have several small holes drilled in them to allow the water to be dispersed at different intervals along the hole opener. Attached to the drill stem 105 is a front plate 115 and a rear plate 120 that extend substantially perpendicular from the drill stem 105. Bridging the outer edges of the front plate 115 and the rear plate 120 is a cylindrical ring 125. The ring need not be cylindrical but could, for example, be in the shape of a polygon with a number of sides depending on the number of cutters to be installed on the hole opener. The cylindrical ring 125 can be a steel pipe of the appropriate diameter that is welded to the outside edges of the front and rear plates 115, 120. The diameter of the plates 115, 120 and cylindrical ring 125 is dependent upon the desired diameter of the cutting tool. The combination of the front plate 115, the rear plate 120, and the cylindrical ring 125 is referred to herein as a barrel because a hollow cylindrical structure is formed around the drill stem 105. In alternate embodiments, the barrel need not be formed of separate pieces but could be cast as one individual piece having holes through which the drill stem may be inserted and secured in place.

For tools of sufficient diameter, material ports 130 may be located in both the front plate 115 and the rear plate 120. The material ports 130 allow material such as dirt, mud, and rocks to pass through the hole opener while it is in operation. Material ports such as these can be placed in the front plate 115 and rear plate 120 without compromising the structural integrity of the support structure for the cone cutters 135. For a hole opener of sufficient diameter, the material ports in the front plate 115 can be made large enough such that if a cone cutter 135 breaks off during operation it will pass through one of the material ports 130 in the front plate 115 and be trapped inside the barrel. The material ports in the back plate are made smaller than the cone cutter 135 so that the cone cutter 135 cannot pass through the material ports in the rear plate 120. Thus, whenever the hole opener is pulled from the hole the cone cutter 135 that was broken off is also removed. Normally, if a cone cutter is left in the hole, the hole must be redrilled at a different location. Thus, considerable expense is saved by producing a hole which is clean and free of debris or other material that would damage a pipe as it is being pulled into the hole. Although the embodiment of FIG. 1 shows four material ports of a rectangular shape, any number of ports of various shapes may be used without departing from the scope and spirit of the invention. Furthermore, although an equal number of material ports are shown in the front plate 115 and the rear plate 120, a different number of ports could be placed in the rear plate 120. As an example, if the material ports in the rear plate are smaller than those in the front plate 115 it may be desirable to provide a greater number of ports in the rear plate 120 to allow the material to flow through more easily. Thus, it is also obvious that the material ports in the front plate need not be in alignment with the material ports in the rear plate.

Each cone cutter 135 is attached to a support arm which is described in greater detail below. The support arm of each cone cutter 135 is attached to the cylindrical ring 125. The cone cutters 135 can have different patterns for the rows of teeth to avoid a strip in the hole being drilled which is not being touched by the teeth. Two different cutter patterns 135*a*, 135*b* are shown in FIG. 1. The invention is not limited to a hole opener with only two cutter patterns. The tool could have four or more different patterns depending on the number of cone cutters to reduce vibration. For example, the use of a four-cone pattern further reduces vibration by requiring each cone to cut less material than would a three-cone pattern. The present invention, by allowing more cutters to be placed around the circumference of the hole opener, also allows a greater number of cone patterns to be implemented.

The combination of the cone cutter with the support structure is referred to herein as a segment 140. Tapered pockets 145 are attached around the circumference of the barrel to provide a receptacle for the segments 140. Thus, the segments 140 may be removed and replaced as they wear out or as different types of material are encountered requiring different types of cone cutters. It is well known in the art that the cone cutters 135 will vary depending upon the type of material that is being bored. Cone cutters of different type and orientation than that shown in FIG. 1 may be used without departing from the scope and spirit of the invention. Furthermore, a combination of different types of cutters may be used at the same time to provide a more efficient hole opener. In addition, cone cutters of a different diameter than those shown in FIG. 1 could be used to change the overall diameter of the hole opener, thereby making small changes in the diameter of the resulting hole as desired.

Typically, the hole opener is pulled through the pilot hole using the drill stem 105. A power source is attached to the front side of drill stem 105 to provide a rotational force as well as a pulling force for operating the hole opener. If the hole opener is operated in a counter-clockwise direction 150, each of the cone cutters rotate in a direction 155 opposite the rotation of the tool as they contact the material being drilled.

Figure 2:
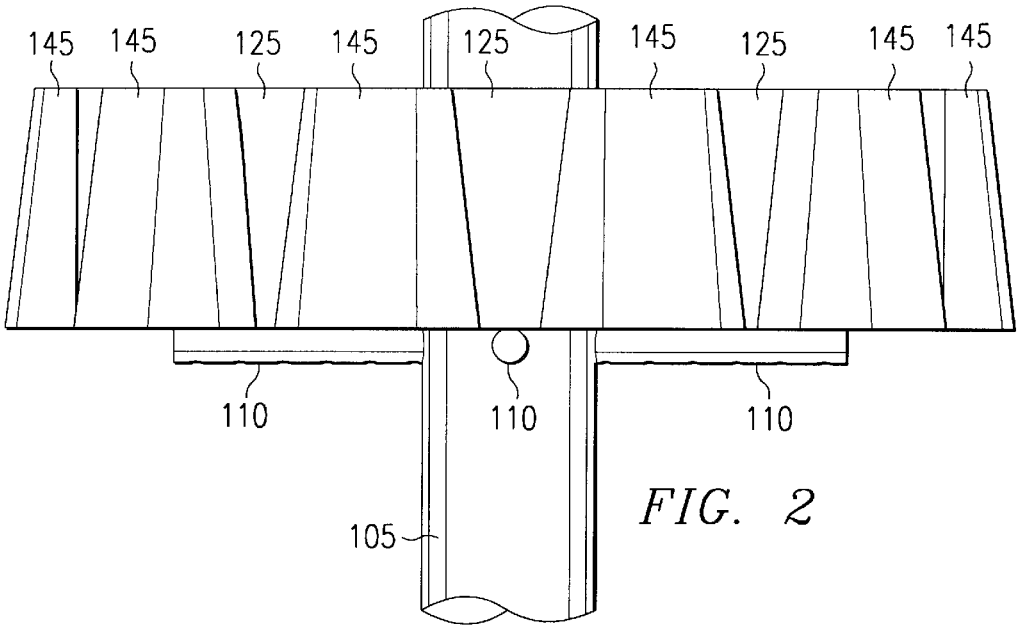
FIG. 2 is a side view of the hole opener of FIG. 1 with segments removed.

Referring now to FIG. 2, a side view of the hole opener of FIG. 1 is illustrated with the segments 140 removed. Throughout the detailed description, like numerals are used to denote like parts unless otherwise noted. The tapered pockets 145 are preferably made of mild steel and welded to the barrel 125. Mild steel allows a certain amount of stretch which results in a tighter fit for the segments 140. The water tubes 110 are placed adjacent to the front plate 115 behind the cutting plane of the cone cutters 135.

Figure 3:
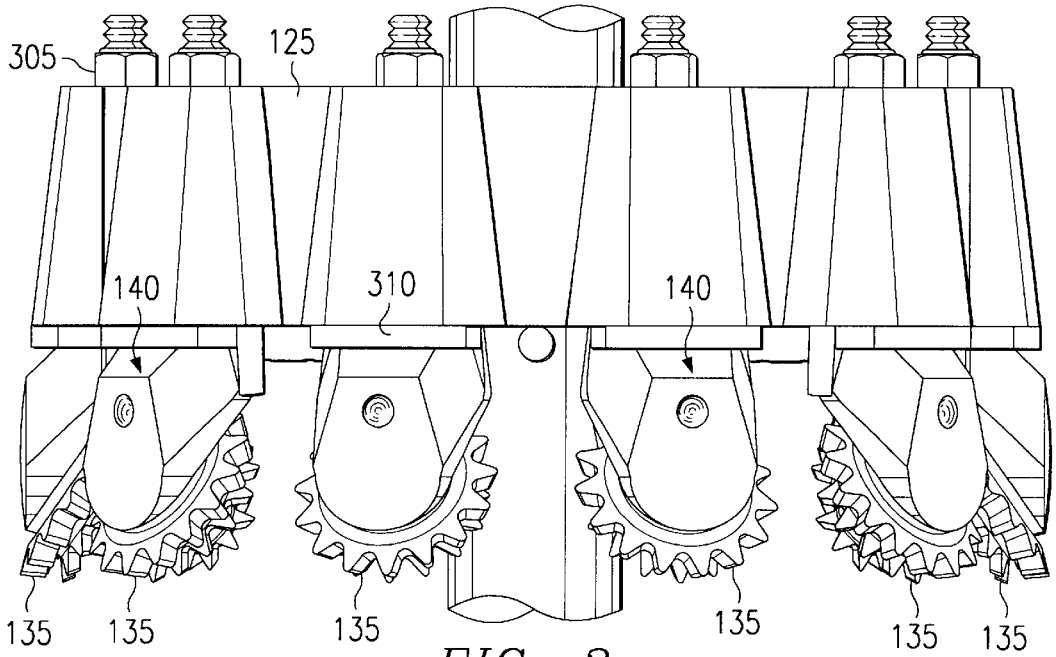
FIG. 3 is a side view of the hole opener of FIG. 1 as illustrated with segments installed into tapered pockets.

Referring now to FIG. 3, a side view of the hole opener of FIG. 1 is illustrated with the segments 140 installed into the tapered pockets 145. The removable segments 140 may be secured using a locking hexnut 305 or may be double nutted to prevent inadvertent loosening of the segment during operation. Tightening the hexnut produces a friction lock between the segment 140 and the tapered pocket 145. A flange 310 protruding from segments 140 is used to provide a stop to indicate that segment 140 has been drawn completely into the tapered pocket 145.

Figure 4:
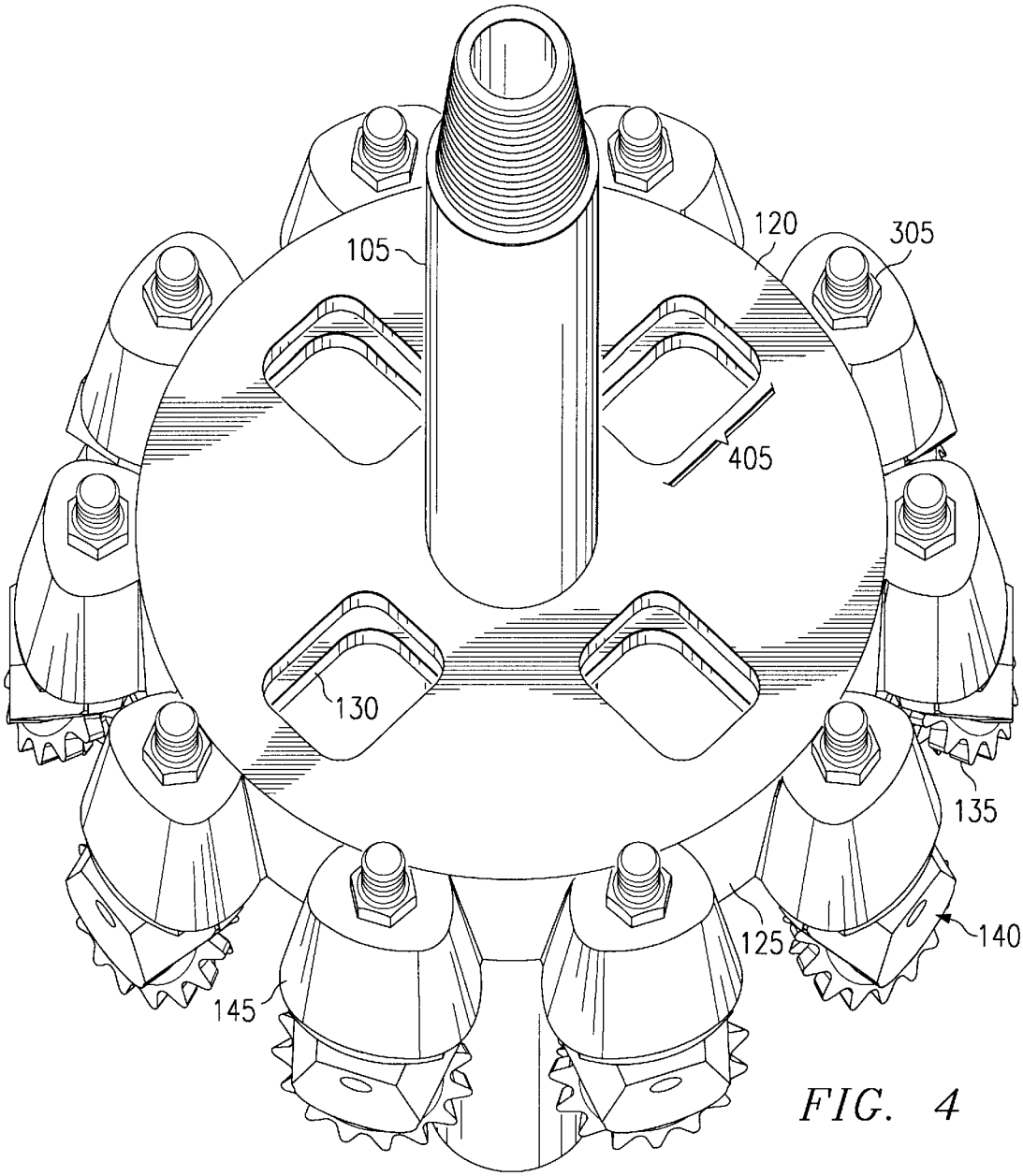
FIG. 4 is a rear perspective view of the hole opener of FIG. 1.

Referring now to FIG. 4, a rear perspective view of the hole opener of FIG. 1 is illustrated. The material ports 405 in the rear plate 120 are smaller than the material ports 130 that are in the front plate. This prevents a broken cone cutter 135 from passing through the barrel 125 once it is trapped inside. The rear end of the drill stem 105 may be threaded to allow the attachment of additional hole openers of larger diameter depending on the diameter of the hole that must be drilled and the power source available to drive the tool. Thus, if sufficient power is available, a large diameter hole may be opened using two or more hole openers of increasing diameter attached in series. If an additional hole opener is not being used, then the rear end of the drill stem may be capped to prevent water from flowing out of the drill stem and to protect the threads on the drill stem.

Figure 5:
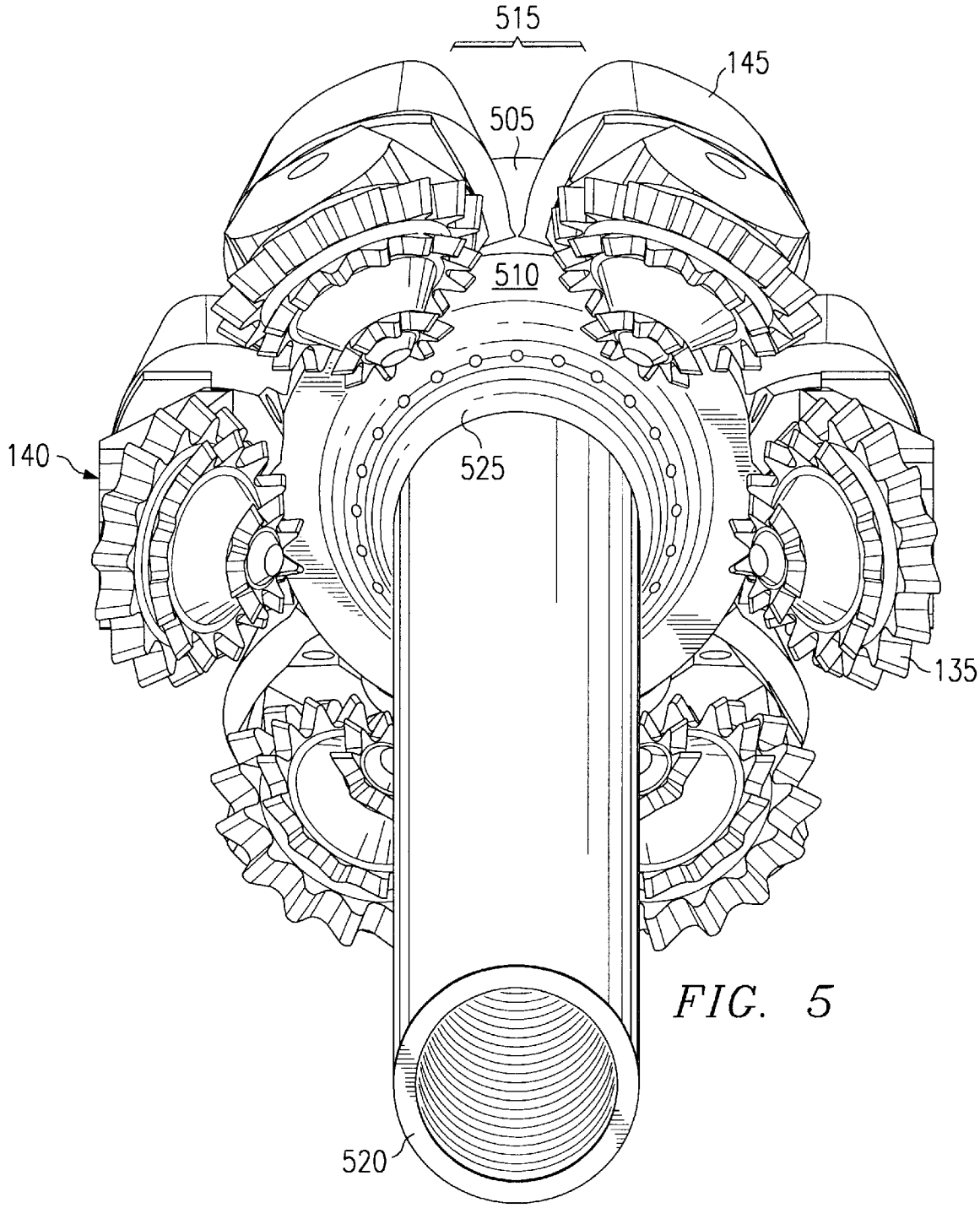
FIG. 5 is a front perspective view illustrating another embodiment of a hole opener in accordance with the present invention.

Referring now to FIG. 5, another embodiment of a hole opener in accordance with the present invention is illustrated. This embodiment has fewer cone cutters 135 than are illustrated in the embodiment of FIG. 1 to allow the diameter of the hole opener to be decreased while keeping the same size cone cutters. In this embodiment there are no holes in the front plate 510 or the rear plate (not shown). This is because there is not enough room between the drill stem 520 and the cone cutters 135 to allow for material ports. However, for a cutter of this size, there is sufficient room between the cone cutters 135 for material to pass. Because the diameter of the hole is much smaller, there is less material that is required to be passed by the cutter, and therefore, the holes in the plates are unnecessary in this embodiment. The tapered design of the hole opener from front to back, as can be seen in FIG. 2 or FIG. 3, also allows for the passage of material over the top of the segments 140.

The tapered design of the embodiment of the invention shown allows the hole opener to be easily pushed back through the hole that has been cut. The hole opener may also be rotated as it is being pushed back through the hole. This "double cutting" of the hole provides a much cleaner hole than was possible with prior art tools by pushing the loose material out of the hole. When drilling a hole of a length that requires the use of multiple segments of drill stem, the hole opener may be pushed back to the point of entry before removing each segment of the drill stem. This process makes it easier to mechanically push debris out of the hole because the debris is removed in smaller portions. Then, when the hole is drilled all the way through, the tool can be pushed back to the point of entry one final time and attached to the pipeline or cable and pulled back through the hole for removal at the point of exit. Using this method, it is not necessary to flood the hole with enough drilling fluid to wash the debris out of the hole. Thus, much less drilling fluid is used and a cleaner hole results.

The barrel 505 may be made from a pipe of smaller diameter than that in FIG. 1, but it accomplishes the same purpose of providing a support structure for the cone cutters 135 which allows more cone cutters 135 to be placed around the diameter of the hole cutter than was allowed using prior art methods. Therefore the tool is much smoother operating and requires less power to operate. This embodiment also illustrates the use of a water reservoir 525 rather than the water tubes 110 shown in FIG. 1. The reservoir can be made using a reducer by welding it to the front plate 510 and the drill stem 520. Holes are cut in the reservoir 525 to allow water to be dispersed and mixed with the loose material. Water is pumped into the reservoir 525 through holes drilled in the drill stem 520 located inside the reservoir 525.

Figure 6:
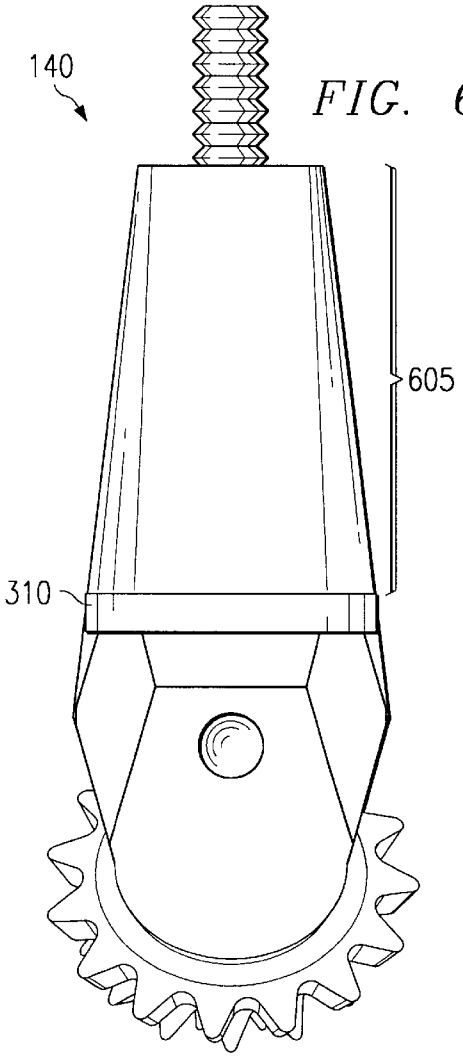
FIG. 6 is a top view of a segment used in one embodiment of the present invention.

Referring now to FIG. 6, a top view of the segment 140 shown in FIG. 1 and FIG. 5 is illustrated. The flange 310 used to provide a stop for the segment 140 is illustrated in greater detail. The taper 605 of the segment is also illustrated. This tapered design allows a wedge fit between the segments 140 and the pocket 145 thereby securing the segment 140 tightly to the barrel 125 to avoid movement caused by excessive forces during operation.

Figure 7:
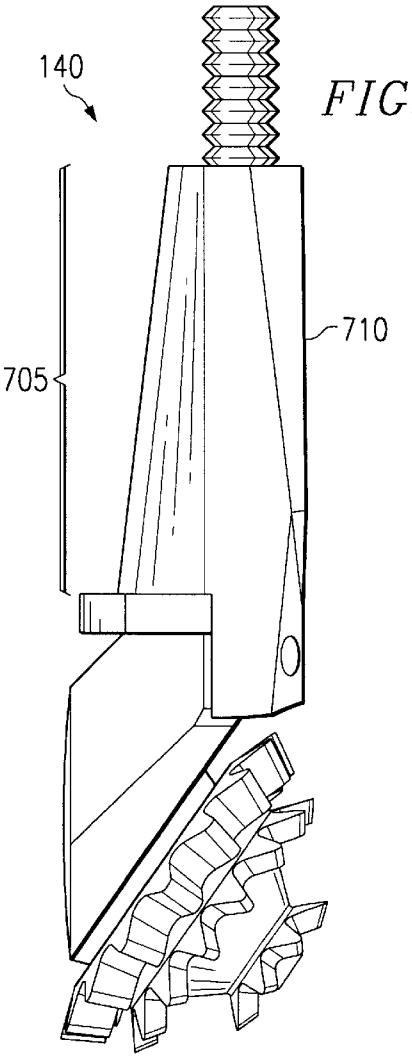
FIG. 7 is a side view of a segment used in one embodiment of the present invention.

Referring now to FIG. 7, a side view of the segment 140 is illustrated. The tapered support arm 705 of the segment 140 is tapered along several planes to prevent the segment from twisting or turning inside the pocket during operation. The bottom 710 of the tapered arm may be curved slightly to allow a snug fit with the barrel. Thus the bottom is relatively flat compared to the remainder of the tapered arm 705. Alternatively, the support arm could be cone-shaped with a keyway cut in the support arm for inserting a key which would mate with a keyway inside a cone-shaped pocket. Thus the tapered arm could be cone shaped without the planes used in the embodiment shown. Other emodiments of this pocket structure may be used without departing from the scope and spirit of the invention.

Figure 8:
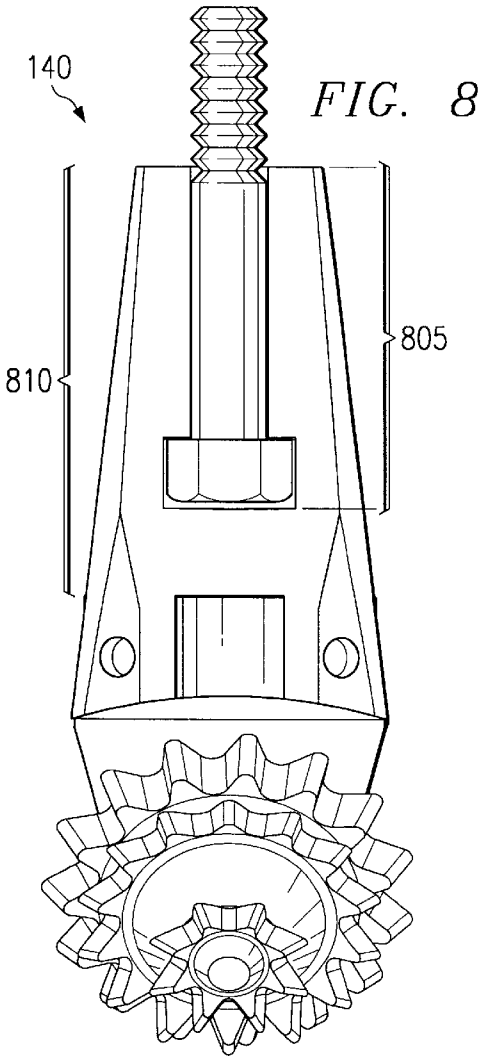
FIG. 8 is a bottom view of a segment used in one embodiment of the present invention.

Referring now to FIG. 8, a bottom view of the segment 140 is illustrated. A slot 805 in the segment is provided for a hexhead bolt to be placed for meshing the segment 140 in the tapered pocket. The bolt slides down inside the slot 805 and is held in place by the barrel 125 as the segment is slid into the tapered pocket. The slot is such that the bolt is not allowed to rotate within the segment 140 when the segment 140 is placed inside the tapered pocket 145. Because the bolt is removable from the slot whenever the segment is removed from the tapered pocket, the bolt may be replaced if it is damaged during removal or operation of the hole cutting tool. In fact, the bolt itself may be used to drive the segment out of the tapered pocket by removing the nut from the end of the bolt and hammering directly on the bolt. Obviously, when the bolt is hammered in this manner, the threads may be damaged, but because the bolt can be removed easily, it can be replaced with a new bolt when the segment is reinserted into the tapered pocket. If the segments were tapped with threads instead of using a bolt insert as described above, the whole segment would have to be replaced if the threads inside the segment were damaged or stripped. Thus, the present invention saves significant expense by increasing the life of the segments using the replaceable bolts.

Thus, the present invention provides a means for mounting segments on a hole opener which allows the segment to be spaced closer together while providing better structural support than is allowed in the prior art. The means for mounting the segments in the prior art limits the number of segments that may be placed in a plane perpendicular to the drill stem to four segments. Smaller boring heads may receive from one to two extra segments using the method of the present invention. The addition of extra segments increases the cutting surface of the tool and results in a smoother operation requiring less torque from the power source drill stem. The tool of the present invention also allows a finished hole which is more round than is allowed by the tools of the prior art.

While the invention has been particularly shown and described above with reference to a preferred embodiment, it will be understood by those skilled in the art that various changes in form and detail may be made therein without departing from the spirit and scope of the invention. For example, various types of cutters may be used. The tapered pockets for the segments could be of a different shape. Numerous types of attachments to the barrel itself may be used, and different styles of drilling fluid transfer could be used, all without departing from the scope and spirit of the invention.

What is claimed is:

1. A hole opener for opening a pilot hole comprising:

a drill stem for transmitting power to said hole opener;

a circular front plate attached to said drill stem;

a circular rear plate attached to said drill stem wherein said rear plate is separated a distance from said front plate;

a ring for providing support having a front end and a rear end wherein said front end of said ring is attached to an outer edge of said circular front plate and wherein said rear end of said ring is attached to an outer edge of said circular rear plate; and a plurality of segments attached to said ring for providing a cutting surface for said hole opener.

2. The hole opener of claim 1 wherein said circular front plate and said circular rear plate extend radially outward from said drill stem.

3. The hole opener of claim 2 wherein said ring is axially aligned with said drill stem.

4. The hole opener of claim 1 further comprising a plurality of pockets attached to said ring for removably attaching said plurality of segments to said ring.

5. The hole opener of claim 4 wherein said plurality of pockets are tapered for providing a friction lock with said plurality of segments.

6. The hole opener of claim 4 wherein each of said segments is attached to a respective pocket using a respective bolt that is embedded in said segment such that a nut may be placed on the end of each bolt to secure said associated segment in its pocket.

7. The hole opener of claim 6 wherein said respective bolt is embedded in a slot in said segment such that said bolt may be easily removed from said segment upon removal of said segment from said respective pocket.

8. The hole opener of claim 4 wherein a longitudinal axis of each of said plurality of pockets is aligned with said drill stem.

9. The hole opener of claim 1 wherein said front plate and said rear plate each have at least one material port for allowing the passage of material through said boring head.

10. The hole opener of claim 9 wherein said material port in said front plate is large enough to allow a cone cutter to pass through said front plate during operation of said hole opener and wherein said material port in said rear plate is small enough to prevent said cone cutter from passing through said rear plate.

11. The hole opener of claim 1 further comprising a fluid communicator for dispersing a drilling fluid from said drill stem.

12. The hole opener of claim 11 wherein said fluid communicator comprises a plurality of tubes attached to said drill stem.

13. The hole opener of claim 12 wherein said plurality of tubes are attached to said drill stem adjacent to said front plate.

14. The hole opener of claim 11 wherein said fluid communicator comprises a reservoir attached to said drill stem and said front plate wherein said reservoir has a plurality of holes for dispersing said drilling fluid at a plurality of locations.

15. An apparatus for use in directional drilling comprising:

a drill stem for transmitting power to said apparatus;

a barrel attached to said drill stem having a front end and a rear end wherein said front end has a first hole and said rear end has a second hole centered at a longitudinal axis of said barrel and wherein said drill stem passes through said first hole and said second hole; and a plurality of cutters attached to an outside surface of said barrel for providing a cutting surface for said apparatus wherein said cutters protrude over said front end of said barrel.

16. The apparatus of claim 15 wherein said plurality of cutters form a largest diameter of said apparatus such that said apparatus is tapered inward from a leading edge of said plurality of cutters to said rear end of said barrel.

17. The apparatus of claim 15 further comprising a plurality of pockets attached to said barrel for removably attaching said plurality of cutters to said barrel.

18. The apparatus of claim 17 wherein said plurality of pockets are tapered for providing a friction lock with said plurality of cutters.

19. The apparatus of claim 17 wherein each of said plurality of cutters is attached to a respective pocket using a respective bolt that is embedded in a respective cutter such that a nut may be placed on an end of said respective bolt to secure said respective cutter in said respective pocket.

20. The apparatus of claim 19 wherein said respective bolt is embedded in a in said respective cutter such that said bolt may be easily removed from said respective cutter upon removal of said respective cutter from said respective pocket.

21. The apparatus of claim 17 wherein a longitudinal axis of each of said plurality of pockets is aligned with said drill stem.

22. The apparatus of claim 15 wherein said front end and said rear end have at least one material port for allowing the passage of material through said apparatus.

23. The apparatus of claim 22 wherein said material port in said front end is large enough to allow one of said plurality of cutters to pass through said front end during operation of said apparatus and wherein said material port in said rear end is small enough to prevent said one of said plurality of cutters from passing through said rear end.

24. The apparatus of claim 15 further comprising a fluid communicator for dispersing a drilling fluid along a front side of said barrel.

25. The apparatus of claim 24 wherein said fluid communicator comprises a plurality of tubes attached to said drill stem.

26. The apparatus of claim 25 wherein said plurality of tubes are attached to said drill stem adjacent to said front end.

27. The apparatus of claim 25 wherein said means for dispersing a drilling fluid comprises a reservoir attached to said drill stem and said front end wherein said reservoir has a plurality of holes for dispersing said drilling fluid at a plurality of locations.

28. A segment for use with a hole opener comprising:

a cutter adapted for cutting a material; and a tapered support arm attached to said cutter wherein said tapered support arm is adapted for insertion into a pocket attached to said hole opener and wherein said tapered support arm has a slot to receive a fastener for removably securing said segment to said pocket.

29. The segment of claim 28 wherein said fastener comprises a bolt wherein said slot is shaped to allow said bolt to nest in said tapered support arm such that a threaded end of said bolt protrudes from an end of said tapered support arm such that when said segment is placed into an open end of said pocket, said threaded end of said bolt protrudes through a closed end of said pocket to allow a nut to be placed on said threaded end of said bolt to hold said segment securely in said pocket.

30. The segment of claim 28 further comprising a flange attached to said tapered support arm adjacent to said cutter for stopping said segment as said segment is drawn into said pocket by said fastener.

31. The segment of claim 28 wherein said tapered support arm is tapered in at least two planes for preventing said segment from twisting inside said pocket.

32. A method for directional drilling comprising the following steps:

drilling an enlarged hole in a forward direction using a hole opener; and moving said hole opener in a reverse direction opposite said forward direction to displace debris left in said enlarged hole, wherein said hole opener comprises: a drill stem for transmitting power to said hole opener; a barrel attached to said drill stem having a front end and a rear end wherein said front end has a first hole and said rear end has a second hole centered at a longitudinal axis of said barrel and wherein said drill stem passes through said first hole and said second hole; a plurality of cone cutters attached to said barrel for providing a cutting surface for said apparatus wherein said cone cutters protrude over said front end of said barrel, and wherein said hole opener is tapered inward from a front edge of said plurality of cone cutters to said rear end of said barrel for reducing friction during said step of moving said hole opener.

33. The method of claim 32 wherein said step of drilling comprises:

drilling said enlarged hole part way through a barrier to a stopping point;

moving said hole opener in said reverse direction to displace debris;

moving said hole opener in said forward direction to said stopping point; and removing a segment from a drill stem attached to said hole opener.

34. An apparatus for use in directional drilling comprising:

a drill stem for transmitting power to said apparatus;

a barrel attached to said drill stem having a front end and a rear end wherein said front end has a first hole and said rear end has a second hole centered at a longitudinal axis of said barrel and wherein said drill stem passes through said first hole and said second hole;

a plurality of cone cutters attached to said barrel for providing a cutting surface for said apparatus wherein said cone cutters protrude over said front end of said barrel; and a plurality of pockets attached to said barrel for removably attaching said plurality of cone cutters to said barrel.

35. The apparatus of claim 34 wherein said plurality of pockets are tapered for providing a friction lock with said plurality of cone cutters.

36. The apparatus of claim 34 wherein each of said plurality of cone cutters is attached to a respective pocket using a respective bolt that is embedded in said cone cutter such that a nut may be placed on a threaded end of said respective bolt to secure said cone cutter in its respective pocket.

37. The apparatus of claim 36 wherein said respective bolt is embedded in a slot in said cone cutter such that said bolt may be easily removed from said cone cutter upon removal of said cone cutter from said respective pocket.

38. The apparatus of claim 34 wherein a longitudinal axis of each of said plurality of pockets is aligned with said drill stem.

39. The apparatus of claim 34 wherein said front end and said rear end have at least one material port for allowing the passage of material through said apparatus.

40. The apparatus of claim 39 wherein said material port in said front end is large enough to allow one of said plurality of cone cutters to pass through said front end during operation of said apparatus and wherein said material port in said rear end is small enough to prevent said one of said plurality of cone cutters from passing through said rear end.

41. The apparatus of claim 34 further comprising a fluid communicator for dispersing a drilling fluid along a front side of said barrel.

42. The apparatus of claim 41 wherein said fluid communicator comprises a plurality of tubes attached to said drill stem.

43. The apparatus of claim 42 wherein said plurality of tubes are attached to said drill stem adjacent to said front end.

44. The apparatus of claim 42 wherein said fluid communicator comprises a reservoir attached to said drill stem and said front end wherein said reservoir has a plurality of holes for dispersing said drilling fluid at a plurality of locations.

45. An apparatus for use in directional drilling comprising:

a drill stem for transmitting power to said apparatus;

a barrel attached to said drill stem having a front end and a rear end wherein said front end has a first hole and said rear end has a second hole centered at a longitudinal axis of said barrel and wherein said drill stem passes through said first hole and said second hole and wherein said front end and said rear end have at least one material port for allowing the passage of material through said apparatus and wherein said material port in said front end is large enough to allow one of said plurality of cone cutters to pass through said front end during operation of said apparatus and said material port in said rear end is small enough to prevent said one of said plurality of cone cutters from passing through said rear end; and a plurality of cone cutters attached to said barrel for providing a cutting surface for said apparatus wherein said cone cutters protrude over said front end of said barrel.

46. An apparatus for use in directional drilling comprising:

a drill stem for transmitting power to said apparatus;

a barrel attached to said drill stem having a front end and a rear end wherein said front end has a first hole and said rear end has a second hole centered at a longitudinal axis of said barrel and wherein said drill stem passes through said first hole and said second hole;

a plurality of cone cutters attached to said barrel for providing a cutting surface for said apparatus wherein said cone cutters protrude over said front end of said barrel; and a fluid communicator for dispersing a drilling fluid along a front side of said barrel.

47. The apparatus of claim 46 wherein said fluid communicator comprises a plurality of tubes attached to said drill stem.

48. The apparatus of claim 47 wherein said plurality of tubes are attached to said drill stem adjacent to said front end.

49. The apparatus of claim 46 wherein said fluid communicator comprises a reservoir attached to said drill stem and said front end wherein said reservoir has a plurality of holes for dispersing said drilling fluid at a plurality of locations.

* * * * *

UNITED STATES PATENT AND TRADEMARK OFFICE

CERTIFICATE OF CORRECTION

PATENT NO. : 6,386,298 B1
DATED : May 14, 2002
INVENTOR(S) : Smith et al.

It is certified that error appears in the above-identified patent and that said Letters Patent is hereby corrected as shown below:

Column 8,
Lines 55 through 59, should read
-- 20. The apparatus of claim 19 wherein said respective bolt is embedded in a slot in said respective cutter such that said bolt may be easily removed from said respective cutter upon removal of said respective cuttter from said respective pocket. --

Signed and Sealed this

Eighth Day of October, 2002

*Attest:*

*Attesting Officer*

JAMES E. ROGAN
*Director of the United States Patent and Trademark Office*